US008061427B2

(12) United States Patent
Jackson et al.

(10) Patent No.: US 8,061,427 B2
(45) **Date of Patent: *Nov. 22, 2011**

(54) WELL PRODUCT RECOVERY PROCESS

(75) Inventors: Robert A. Jackson, Dewinton (CA); Donald MacDonald, Calgary (CA)

(73) Assignee: Sanjel Corporation, Calgary (CA)

( * ) Notice: Subject to any disclaimer, the term of this patent is extended or adjusted under 35 U.S.C. 154(b) by 836 days.

This patent is subject to a terminal disclaimer.

(21) Appl. No.: 11/421,034

(22) Filed: May 30, 2006

(65) Prior Publication Data

US 2007/0023184 A1 Feb. 1, 2007

Related U.S. Application Data

(60) Provisional application No. 60/595,064, filed on Jun. 2, 2005.

(30) Foreign Application Priority Data

Aug. 29, 2005 (CA) ..... 2517494

(51) Int. Cl.
*E21B 43/267* (2006.01)

(52) U.S. Cl. ..... 166/308.1; 166/250.1; 166/280.1; 166/401

(58) Field of Classification Search ..... None
See application file for complete search history.

(56) References Cited

U.S. PATENT DOCUMENTS

| | | | | |
|---|---|---|---|---|
| 3,933,205 | A | 1/1976 | Kiel | |
| 4,434,848 | A | 3/1984 | Smith | |
| 4,512,405 | A | 4/1985 | Sweatman | |
| 4,569,394 | A | 2/1986 | Sweatman et al. | |
| 5,143,156 | A | 9/1992 | Bromley | |
| 5,249,627 | A | 10/1993 | Harms et al. | |
| 5,390,741 | A * | 2/1995 | Payton et al. | 166/284 |
| 5,531,274 | A | 7/1996 | Bienrenu, Jr. | |
| 5,883,053 | A | 3/1999 | Tudor | |
| 5,908,267 | A | 6/1999 | Schuring et al. | |
| 6,059,034 | A | 5/2000 | Richards et al. | |
| 6,283,212 | B1 | 9/2001 | Hinkel et al. | |
| 6,729,409 | B1 | 5/2004 | Gupta et al. | |
| 2002/0195246 | A1 | 12/2002 | Davidson | |

(Continued)

FOREIGN PATENT DOCUMENTS

| | | |
|---|---|---|
| CA | 2471559 | 12/2004 |

OTHER PUBLICATIONS

Cleat Characterisation,Imperial College London, presentation prior to Jun. 2, 2005.

(Continued)

*Primary Examiner* — Zakiya W Bates

(74) *Attorney, Agent, or Firm* — Bennett Jones LLP

(57) ABSTRACT

A process for fracturing a selected region of a formation including: introducing a supply of fracturing fluid to the region of the formation until a first threshold is reached, adjusting the flow of the fracturing fluid to the region of the formation to reach a second threshold, adjusting the flow of the fracturing fluid to the region of the formation to reach a third threshold and ceasing flow of the fracturing fluid to region of the formation, the fracturing fluid being a non-participating gas and including a proppant in at least one of the stages of flow of the fracturing fluid.

82 Claims, 5 Drawing Sheets

U.S. PATENT DOCUMENTS

2007/0000666 A1* 1/2007 Vozniak et al. ..... 166/308.1

OTHER PUBLICATIONS

John D. Campbell, Major Cleat Trends in Alberta Plains Coals, Feb. 1979, p. 69, 70, CIM Bulletin, Feb. 1979, Edmonton, Alberta, Canada.

Othar M. Kiel, The Kiel Process—Reservoir Stimulation by Dendritic Fracturing, pp. 1-29, Houston, Texas, USA.

H.H. Abass, M.L. Van Domelen and W.M. El Rabaa, Experimental Observations of Hydraulic Fracture Propagation, Society of Petroleum Engineers, Inc. Nov. 1990, p. 239-251, Ohio US.

R.G. Jeffrey et al, Stimulation for Methane-Gas Recovery From Coal, Aug. 1998, pp. 200-207, Wyoming, USA.

M. J. Mayerhofer et al, Proppants? We Don't Need No Proppants, 1997, pp. 457-464, Society of Petroleum Engineers, Texas, USA.

J.C. Gottschling et al, Nitrogen Gas and Sand: A New Technique for Stimulation of Devonian Shale, May 1985, p. 901-907, Journal of Petroleum Technology.

H.H. Abass, S. Hedayati, C.M. Kim, Experimental Simulation of Hydraulic Fracturing in Shallow Coal Seams, SPE Eastern Regional Meeting, Oct. 22-25, 1991, Oklahoma USA.

* cited by examiner

WELL PRODUCT RECOVERY PROCESS

FIELD

This application pertains to the field of recovering flows from wells.

BACKGROUND

A hydrocarbon bearing geological formation may include many different layers from which commercially valuable products may be obtained. In some instances, it may be desirable to recover gases from a substantially porous layered medium. That layered medium may or may not have been a zone from which commercial recovery of a product was originally foreseen at the time of original exploitation of that geological formation. However, the overall commercial recovery from well drilling and production operations in that formation may include an opportunity to obtain value from the formation by enhancing recovery from that formation, as by fracturing.

SUMMARY

In one aspect of the invention, there is a process for fracturing a formation including: introducing a supply of fracturing fluid to the formation until a first threshold is reached, adjusting the flow of the fracturing fluid to reach a second threshold, adjusting the flow to reach a third threshold and ceasing flow of the fracturing fluid to the formation, the fracturing fluid being a non-participating gas. In one embodiment, after reaching the third threshold and prior to ceasing flow, further thresholds may be reached by adjustment of fracturing fluid flow before ceasing the process. In one embodiment, the formation to be fractured may be a coal seam and the fluid may be a gas that is substantially free of water. One possible gas may include nitrogen.

In another aspect of the invention, a proppant may be used and thus there may be provided a process for fracturing a selected region of a formation including: introducing a supply of fracturing fluid to the region of the formation until a first threshold is reached, adjusting the flow of the fracturing fluid to the region of the formation to reach a second threshold, adjusting the flow of the fracturing fluid to the region of the formation to reach a third threshold and ceasing flow of the fracturing fluid to region of the formation, the fracturing fluid being a non-participating gas and including a proppant in at least one of the stages of flow of the fracturing fluid.

In another aspect of the invention, there is a process for fracturing a formation including: introducing a supply of fracturing non-participating gas to the formation at a rate of at least 300 standard cubic meters/minute (abbreviated as scm or $sm^3$/min) until a first threshold is reached, adjusting the flow of the fracturing non-participating gas to the formation to reach a second threshold, adjusting the flow to the formation to reach a third threshold, the first, second and third thresholds being reached within a twenty-four hour period, and ceasing flow of the fracturing non-participating gas to the formation, the fracturing non-participating gas including a proppant in at least one of the stages of flow of the fracturing fluid.

In another aspect of the invention there is a process of dilating fractures, which may be cleats or natural fractures, in a seam adjacent to a well bore, that process including the steps of: pressurizing and permitting pressure relaxation of the seam a plurality of times in less than a twenty-four hour period, wherein at least one of the steps of pressurizing includes urging a fracture dilation fluid with a proppant into the seam, the fracture dilation fluid being substantially entirely a non-participating gas.

In one other aspect of the invention there is a process of dilating fractures in a coal seam adjacent to a well bore, that process including the steps of pressurizing and pressure relaxation of the coal seam a plurality of times, wherein at least one of the steps of pressurizing includes introducing a fracture dilation fluid with a proppant into the coal seam, the fracture dilation fluid including a non-participating gas, and at least one of the steps of pressurizing including the step of introducing the fracture dilation fluid at a rate of greater than 300 scm.

In another feature of that aspect of the invention, the process may include a first pressurizing step wherein dilation fluid is introduced at a rate of greater than 1000 scm, a pressure relaxation step thereafter and a second pressurization step wherein dilation fluid is introduced at a rate of greater than 1000 scm, wherein the first and the second pressurizing steps are completed in a time period of less than 24 hours.

In yet another aspect of the invention there is a process of dilating fractures in a seam of a formation adjacent to a well bore, that process including the steps of pressurizing and pressure relaxation of the seam a plurality of times, wherein at least one of the steps of pressurizing includes introducing a fracture dilation fluid with a proppant into the seam, the fracture dilation fluid being substantially entirely non-participating gas, and at least one of the steps of pressurizing including a step of imposing a peak pressure capable of fracture dilation.

In another feature of that aspect of the invention, the step of imposing a peak pressure capable of fracture dilation, may include reaching a surface pressure of greater than 2000 p.s.i. at and/or reaching a bottom hole pressure, measured in the well bore of at least 500 p.s.i. In one embodiment, at least one of the pressurizing steps includes raising the pressure in the surface pressure to more than 2000 p.s.i. in a time period of less than 100 seconds. In another feature, at least one of the pressurizing steps includes a peak surface pressure of over 3500 p.s.i. In a further feature, the peak pressure at surface or bottom hole in at least one of the steps is more than double the overburden pressure at the seam.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BROAD DESCRIPTION

In an aspect of the invention, there is a process for recovering coal bed gas. The process includes the step of selecting a well bore having a producing zone including at least one seam, such as a coal seam, shale seam, sandstone seam, producing or possibly containing a product of interest such as methane, shale gas, natural gas, etc. A supply of fracturing fluid is introduced into the well bore, the fracturing fluid may include a non-participating gas and, if it is advantageous for the formation or the seam, may be substantially free of liquid water. The non-participating gas is urged into the at least one seam through a plurality of thresholds. The flow of the non-participating gas into the well bore continues until a first threshold is reached. The flow is then adjusted to reach a second threshold. The flow is then adjusted to reach a third threshold. Thereafter the process may be ceased or further thresholds may be reached by adjustment of fracturing fluid flow before ceasing the process. A proppant may be used in at least one of the stages of flow of the non-participating gas.

A "non-participating gas" may be a gas that is relatively inert in terms of its chemical (as opposed to mechanical) interaction with the material of the seam and possibly also the formation. Such a gas has little or no tendency to react with the seam to be dilated. "Proppant" is the term used herein to encompass those materials that may be introduced for any of propping, spalling, etching and/or pillaring.

The steps of adjusting flow may include relaxing flow, causing a pressure relaxation step, or increasing flow, causing a pressurization step. A step of relaxing fluid flow may include extracting a portion of the fracturing fluid from the well bore, slowing fluid flow, stopping flow of fracturing fluid into the well bore and/or permitting the fracturing fluid to propagate into a fracture region in the seam adjacent to the well bore. A step of increasing fluid flow may include resuming fluid flow and/or increasing fluid flow over an existing or previous flow.

After the third threshold is reached, the process of introducing fracturing fluid may be ceased or further thresholds may be reached by adjustment of fracturing fluid flow before thereafter ceasing the introduction of fracturing fluid to the coal seam. In another feature, the process may by cyclic including relaxing fluid flow to reach the second threshold and increasing flow to reach the third threshold. In yet another feature, the process may include increasing fluid flow to reach the second threshold and increasing or relaxing flow to reach the third threshold.

In one aspect, the introduction of fracturing fluid may include introducing a volume to substantially fill the void space in the formation prior to introducing fluid to reach the first threshold, the end of such a process may be indicated by break down when fracture initiation commences. As will be appreciated, the point at which the void space of a formation is substantially filled can be determined by a skilled operator.

The thresholds may be defined by at least one criterion selected from a set of criteria consisting of: (a) a time period threshold; (b) a non-participating gas flow rate threshold; (c) a well bore surface or bottom hole pressure threshold; (d) a well bore surface or bottom hole rate of pressure change threshold (e) a gas quantity threshold and (f) a formation condition threshold.

The first threshold may be reached during a pressurization step and that pressurization may be stopped after a fixed time, such as at least one minute, after a peak pressure is reached, after a fixed quantity of flow (which may be measured either as a mass flow or as a normalized volumetric flow, for example) or after a formation condition is determined. Subsequent thresholds may include a pressure relaxation step and that step may be of longer duration than the pressurization step, and may be significantly longer such as 40 or more times as long.

As an example, the first threshold may be reached by introduction of fracturing fluid over a period of time. As will be appreciated, however, generally other process parameters such as flow rate, pressure, volume, formation condition, etc. are observed to assess a formation fracturing process.

As another example, the first threshold may be selected from the group consisting of (a) a time period in the range of 30 seconds to 20 minutes, (b) a flow rate of dilation fluid of at least 300 scm, and (c) a combination of a time period in the range of 30 seconds to 20 minutes and a flow rate of dilation fluid of at least 300 scm. In one embodiment, the first threshold is defined as an introduction of fluid for a time period in the range of 1 to 10 minutes and a flow rate of dilation fluid of at least 1000 scm. Generally, a flow rate above 3,000 scm may be difficult to achieve.

In another feature, the first threshold may be defined, at least in part, by an introduction of dilation fluid for a period of 30 seconds to 20 minutes at a flow rate of at least 300 scm, the second threshold may be defined as a time period of more than 1 minute and less than 24 hours of a flow rate of dilation fluid of less than 300 scm, which may include 0 scm, and the third threshold may be defined as an introduction of dilation fluid for a period of 30 seconds to 20 minutes at a flow rate of at least 300 scm.

The process may also be carried out by reference to surface or bottom hole pressures, in addition to or alternately from observation of the flow rate and time. For example, the threshold for ending pressurization or pressure relaxation step of a pressure pulse may occur after a particular pressure is maintained for a particular time or when the pressure change per unit time is reduced below a particular level. In one possible feature of the invention, the first threshold may be selected from (a) a peak surface pressure of at least 2000 p.s.i. or at least 3500 p.s.i., (b) a peak bottom hole pressure, measured in the well bore of at least 500 p.s.i. and (c) a combination of a time period in the range of 30 seconds to 20 minutes and a peak pressure as in (a) or (b) immediately noted above. In one embodiment, the first threshold may be selected from (a) a peak surface pressure of at least 4500 p.s.i. or possibly at least 5000 p.s.i., (b) a peak bottom hole pressure, measured in the well bore of at least 1000 p.s.i or possibly at least 1500 p.s.i. and (c) a combination of a time period in the range of 1 to 10 minutes and a peak pressure as in (a) or (b) immediately noted above. Bottom hole pressure is considered to be representative of the formation response. The bottom hole pressure and surface treating pressures of the wavetrain may be different due to friction pressure, etc. created from injection of the non-participating gas. Thus, the pressure as measured at surface during gas introduction may be more than that pressure measured downhole. Wellbore pressures may be affected by a number of criteria, some of which are beyond the control of the operator, and, therefore, the pressure during any threshold may fluctuate.

In another feature, the first threshold is defined, at least in part, by a peak pressure, and the second threshold is defined, at least in part, as a proportion of that peak pressure. In a further feature, at the first threshold there is a peak pressure in the well bore of and the second threshold is defined, at least in part, as a proportion of that peak pressure and the fraction of the proportional pressure over the peak pressure lies in the range of $e^{-3}$ and $e^{-1}$.

In yet another feature, the process has a time v. pressure and/or flow characteristic having a sawtooth form, wherein the sawtooth form has a first sawtooth having an increasing pressure and/or flow up to the first threshold, and a decreasing pressure or flow to the second threshold. A second sawtooth having an increasing pressure and/or flow to the third threshold, and a decreasing pressure and/or flow to the fourth threshold, and wherein each of the increases and decreases in pressure and/or flow is associated with a respective time interval, and the first and second saw teeth may be unequal. In an additional feature, each increasing time interval of each of the sawteeth is shorter than the corresponding time interval after each of the sawteeth. The sawtooth form can arise from abrupt or gradual changes in fluid flow.

In still another feature, one of the thresholds is a formation condition threshold such as a lateral fracture threshold or a dendritic fracture threshold. Generally, a dendritic fracture threshold may occur after the lateral fracture threshold.

In other possible features of the methods, some pre or post fracturing operational steps may be carried out, if desired. For example, the formation may be treated to enhance its characteristics. For example, the step of introducing the fracturing fluid into the well bore may be preceded by any of cementing, perforating, employing an activating agent, such as for example an acidic activating agent, in the well bore. Alternately or in addition, if the presence of water is disadvantageous to the process, the step of selecting a well bore may include the step of selecting a well bore that is substantially free of water at the level of the seam of interest and/or the step of introducing the fracturing fluid may be preceded by the step of de-watering the well bore to at least the level of the seam.

In yet another possible feature, a last step may include relaxing fluid flow and is followed by a step of recovering the fracture fluid or reverse circulating to clean the wellbore of excess proppant or for other reasons.

In other possible features, the step of selecting may include the step of forming a new well bore adjacent to an existing well bore and, if so, the step may further include obstructing access to the seam of interest from the existing well bore.

As noted previously, a non-participating gas may be relatively inert in terms of chemical (as opposed to mechanical) interaction with, and has little or no tendency to react with, the seam of interest. In a further feature, the non-participating gas may include nitrogen and may be predominantly nitrogen. In another feature, the non-participating gas may be used as the fracturing fluid substantially entirely alone. Thus, in one embodiment, the non-participating gas may be substantially entirely nitrogen.

As noted previously, the proppant may be useful for propping, spalling, etching and/or pillaring. The proppant may be any one or more of various materials and may be conveyed with the non-participating gas in any one or more of various ways. In one feature, a proppant may include any or all of plastic, resin, composite, ceramic, metal, sand or other natural treated or untreated granular materials such as wood/bark, shells or nut shells.

In a still further possible feature, the process includes the step of repeating the process on a second seam through which the well bore passes. In yet another feature, the process includes the step of isolating the second seam from the first seam and then repeating a fracturing process on the second seam, which process may or may not include at least some of the previously described steps.

These and other aspects and features of the invention are described in the description that follows.

BRIEF DESCRIPTION OF THE FIGURES

Referring to the drawings, several aspects of the present invention are illustrated by way of example, and not by way of limitation, in detail in the figures, wherein.

DETAILED DESCRIPTION

Figure 1:
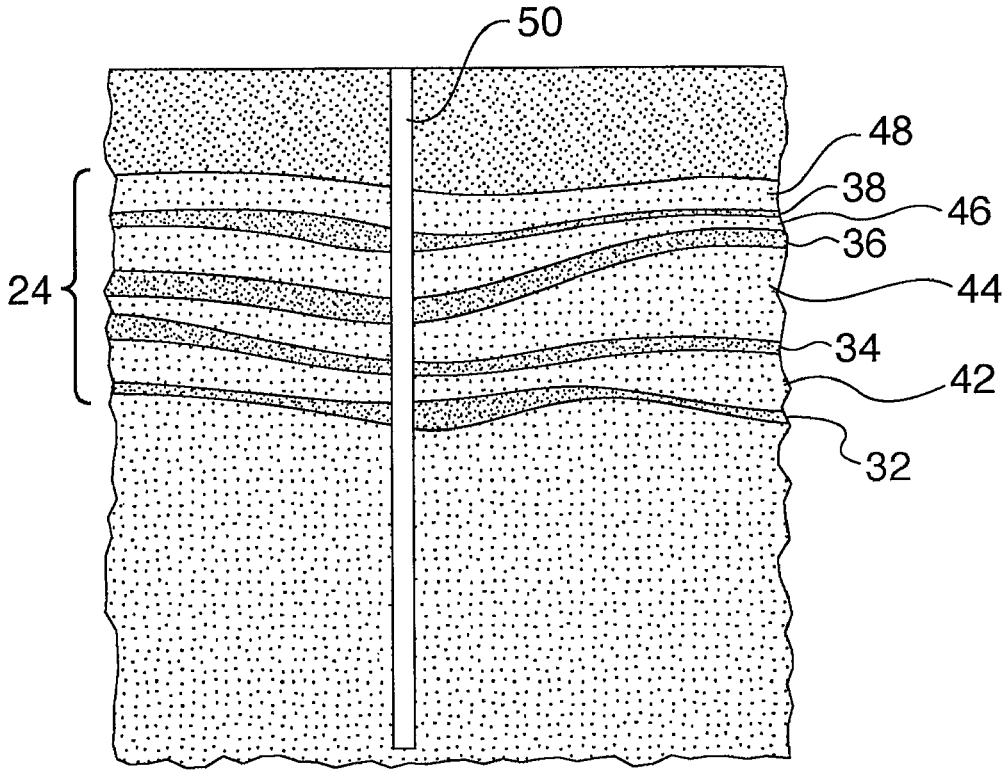
FIG. 1 is a cross section of a geological formation from which it may be desired to recover a commercially valuable product through a well production process.
Figure 2:
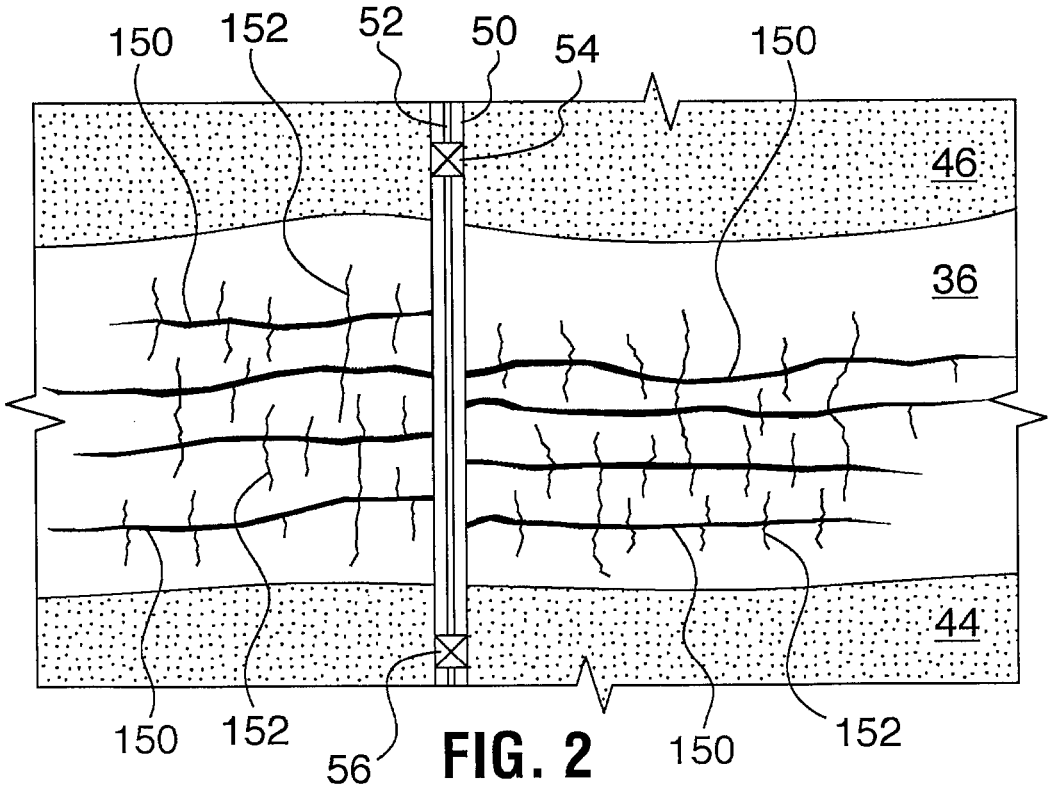
FIG. 2 is an enlarged detail of a portion of FIG. 1 after a stage in a process wherein a fracture dilation process has been performed on a first stratum of the geological formation.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, like parts are marked throughout the specification and the drawings with the same respective reference numerals. The drawings are not necessarily to scale and in some instances proportions may have been exaggerated in order more clearly to depict certain features.

In terms of general orientation and directional nomenclature, two types of frames of reference may be employed. First, although a well may not necessarily be drilled vertically, terminology may be employed assuming a cylindrical polar co-ordinate system in which the vertical, or z-axis, may be taken as running along the bore of the well, and the radial axis may be taken as having the centerline of the bore as the origin, that bore being taken as being, at least locally, the center of a cylinder whose length is many times its width, with all radial distances being measured away from that origin. The circumferential direction may be taken as being mutually perpendicular to the local axial and radial directions. In this terminology, "up" and "down" may not necessarily be vertical, given that slanted, deviated and horizontal drilling may occur, but may be used as if the well bore had been drilled vertically, with the well head being above and therefore uphole of the bottom of the well, whether it is or not. In this terminology, it is understood that production fluids flow up the well bore to the well head at the surface.

Considering FIG. 1, by way of a broad, general overview, a geological formation may include a producing region 24 (and possibly other regions above or below region 24). Region 24 may include one or more hydrocarbon-bearing seams identified in the Figures as 32, 34, 36, and 38. It may be understood that FIG. 1 is intended to be generic in this regard, such that there may only be one such seam, or there may be many such seams. Seams 32, 34, 36, and 38 are separated by interlayers indicated individually in ascending order as 42, 44, 46, and an overburden layer 48 (each of which may in reality be a multitude of various layers), the interlayers and the overburden layer may be distinct from the hydrocarbon bearing seams and may be relatively impervious to the passage therethrough of fluids such as those that may be of interest in seams 32, 34, 36 and 38. It may be noted that the seams may be of varying thickness, from a few inches thick to several tens, hundreds or thousands of feet thick. The seams may, for example, be of coal, sandstone, shale or other rock classifications. One or more of those hydrocarbon bearing seams may be permeable, to a greater or lesser extent such that, in addition to possibly a solid material, (which may be coal, for example), one or more of those seams may also be a fluid bearing stratum (or strata, as may be), the fluid being trapped, or preferentially contained in, that layer by the adjacent substantially non-porous interlayers. The entrapped fluid may be a gas. Such gas may be a hydrocarbon-based gas, such as methane, shale gas, natural gas, butane, etc. The entrapped fluid may be under modest pressure, or may be under relatively little pressure.

At some point in time a well bore 50 may have been drilled from the surface to the region 24. After drilling well bore 50 may have been treated in various ways. For example, well bore 50 may be new, may have reached maturity, may be in decline, or may have ceased to produce. Any of various fluids of interest including substantially liquids such as oil, water and/or brine, gases, mixtures and/or any of mud, sand, or other solid impurities may have or may not have been produced therethrough. The well bore may be completed, lined or open hole and may be deviated, vertical, directional, slanted or horizontal. Well bore 50 may also have been drilled for the intention of producing therethrough or as a subsequent wellbore into that formation for production or formation treatment therethrough. In particular, it will be appreciated that well bore 50 may be in any one or more of various conditions and may have been drilled for any one or more of a number of reasons.

At some point, it may be desired to permit fluid production through the well bore from any of the strata 32, 34, 36 or 38 of region 24. In so doing access is required between the strata of the region and the well bore, as for example may already be provided in an open hole or may be made by perforation through a liner, cement, etc. in the well bore. Once communication is obtained between the strata, fluid may flow from the strata of region 24 into well 50. The flow of interest may be a gas flow, such as of one of the hydrocarbon gases mentioned hereinabove. Initially, prior to the procedure described herein, this flow of gas, may not be as great as might be desired.

In the natural state, each of seams 32, 34, 36 or 38 may exhibit some fractures including natural cleating and fractures, which is to say cracks and fractures in the seam that give a measure of permeability/porosity, such as may tend to permit the fluid to migrate in the seam. The degree of prevalence of fracturing may tend to determine the rate at which the fluid may flow out of the seam. The rate at which the fluid may be extracted may range from a very slow seepage to a more lively flow. Where the flow is not overly vigorous, it may be desirable to enhance the flow rate by encouraging a greater degree of fracturing and/or connecting the fractures, such as to improve the overall porosity/permeability of the hydrocarbon bearing stratum adjacent to well bore 50, or by encouraging "spalling" on the faces of the existing fractures, spalling being a breaking off of the surface material of the fracture face and "pillaring" to hold the fractures open. to allow more flow to the wellbore.

Where flow from a well is poor, an operator may wish to attempt to make the fissures and fractures open, connect and/or propagate away from the well. One such method is to pump a fluid such as a gas or an aqueous, foam or emulsion, into an oil well such that the frac sand may be introduced into the fine fissures under pressure. The pressure may cause the fissures to open somewhat, and then, when the pressure is relieved materials in the injection fluid or from the formation may tend to stay in place, preventing the fractures from closing. This may then leave larger pathways in the geological formation through which oil and gas may flow to the well bore, permitting those desired fluids (and other impurities) to be pumped up to the well head.

There are a number of factors to be considered. First, the fracturing fluid should be considered with respect to its effect on the formation since some fluids may interact with the cleating surfaces in such as way as to close up the fractures, and to impede flow, rather than to facilitate flow. Second, consideration should be given to the ease of removal of the fracturing fluid from the wellbore after the procedure. Third, the nature in which the fluid and process causes fissures to open up or dilate in the formation should be considered.

To enhance production, fluid may be injected to one or more of the formation's seams to frac the formation. In the illustrated embodiment, for example, any or all of seams 32, 34, 36 and/or 38 may be fraced.

Of course, various fluid injection equipment and systems are known and may be employed, as desired to supply fracing fluid to a wellbore or seam. For example, any or all methods including, for example, zonal isolation, tubing and packers, through casing, etc. can be used. In one embodiment, coiled tubing 52 can be used to convey the fracing fluid down the wellbore and bottom hole assembly units 54, 56 may be employed to seal the annulus between the coiled tubing and the borehole wall. The positioning of the units 54, 56 determines the isolated zone to be treated with fracing fluid. The units 54, 56 may therefore be positioned to isolate for treatment one or more seams. In the illustrated embodiment, seam 36 is isolated for treatment. An apparatus for introducing proppant to the fracing fluid may be included at surface. The equipment and systems may include surface and/or bottom hole pressure sensors, flow meters for the fracing fluid and proppant, etc.

A gas under high pressure may be used in the dilation process. A gas may have less tendency than a liquid to cause the material of the stratum to swell. One step may be to select a gas that is relatively inert in terms of chemical (as opposed to mechanical) interaction with the material of the stratum. Such a gas that has little or no tendency to react with the stratum to be dilated may be termed non-participating, or non-reactive. For example, in a carboniferous environment, such as a coal seam, nitrogen gas may be introduced. Although other gases, such as inert, or relatively inert, gases may be used, nitrogen may tend to be readily available and comparatively inexpensive to obtain in large quantities. The gas need not be entirely of one element, but may be a mixture of non-reactive gases. Making allowance for trace elements, the frac fluid chosen may be substantially free of reactive gases or liquids, and may be substantially, or entirely, free of liquids, including being free of aqueous liquids such as water or brine.

A proppant may be used with the injected gas during all or a portion of the dilation process. The proppant may be selected from any of plastic, resin, composite, ceramic, metal, sand or other natural treated or untreated granular materials such as wood/bark, shells or nut shells. A proppant may be selected with consideration to the ability of the proppant to be carried by the fracturing fluid to the seam of interest. For example, light weight materials having a specific gravity of less than 4 may be useful. In one embodiment, a proppant with a specific gravity of about 0.5 to 3 may be used, such as resin-coated sand, sand, or ceramic (for example carbolite).

In one aspect of the invention, there is a process for fracturing a formation such as seam 36 including: urging a flow of fracturing fluid to the well bore 50 into contact with seam 36 until a first threshold is reached, adjusting the flow of the fracturing fluid to the seam 36 to reach a second threshold, adjusting the flow of the fracturing fluid to the seam 36 to reach a third threshold and ceasing flow of the fracturing fluid to the seam, the fracturing fluid being a non-participating gas and including a proppant in at least one of the stages of flow of the fracturing fluid. In one embodiment, after reaching the third threshold and prior to ceasing flow, further thresholds may be reached by adjustment of fracturing fluid flow before ceasing the process.

Figure 3:
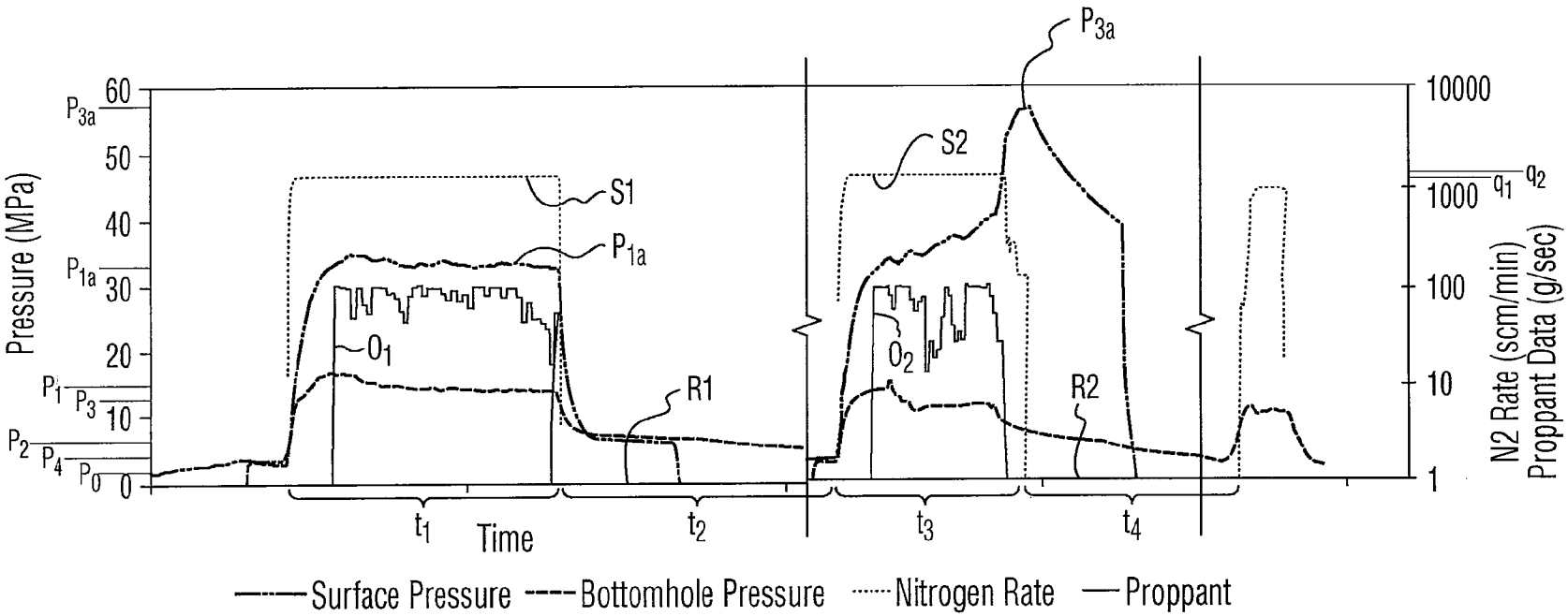
FIG. 3 shows a chart of flow rate and observed pressure against time for a process of fracture dilation.

In one embodiment, with reference to FIG. 3, the introduction of frac fluid, such as non-participating frac gas, to the wellbore may be a cyclic process involving a number of iterations of raising pressure in the well bore adjacent the seam of interest, such as a first surge S1, a second surge S2, etc., with each surge followed by a period of relaxation of the introduction of frac fluid into the formation R1, R2. The steps of relaxation may include cessation of the inflow (as shown), may include lessening the inflow of frac gas, or may include extraction of a portion of the frac gas. Typically, relaxation may involve cessation of the flow, while permitting the surge of frac gas to diffuse, or spread, into the surrounding formation, and, in so doing, to permit the pressure in the surrounding formation, and in the well bore, to decline. The cycles may be irregular. That is to say, although iterations of raising the pressure, and relaxing the pressure in the well bore, and hence in the surrounding formation, may occur in the form of a wavetrain of pulses that are substantially identical in terms of input flow rate and duration, such as to produce a regular wave pattern, in the more general case this need not be so, and may not be so. The amplitude of an individual pulse may or may not be the same as any other, either in terms of maximum frac gas flow rate, or in terms of peak pressure during the pressure pulse, and the duration of the pulses may vary from one to another. Similarly, while the periods of relaxation may be of the same duration, in the general case they need not be, and may not be.

Similarly, too, the transition from one stage of a pulse to another may be defined by any of several criteria, or more than one of them. For example, the adjustment in the introduction of fluid from one threshold to the next may begin at the end of a time period, when a certain volume of gas has been introduced or when a selected pressure is reached.

The pressure rise and relaxation curves may have an arcuate form that is similar to an exponential decay curve, and or resulting pulse may have a sawtooth or angular shape. The faces of the sawtooth may be arcuate, may be exponential decay curves, and may be unequal.

As noted, each successive pulse may be of a different shape. Although a wave train, or pulse train, may have as few as two pulses, it may be that a pulse train of three or more pulses may be employed.

In general, then, a frac fluid in the form of a non-participating gas may be introduced into well bore 50 to pressurize the well bore more than one time per job (i.e. per seam 36 or formation region to be treated). That is, starting from an initial well bore pressure, $P_0$, a first surge S1 of gas may be introduced at a flow rate $q_1$, over a time period $t_1$ to raise the pressure in the stratum, as measured in the well bore, to an elevated level, $P_1$. During this surge S1 an amount of proppant $O_1$ may be entrained with the frac fluid to be conveyed downhole.

Following this rise, a period of relaxation R1 may occur in which the inflow of frac gas may be greatly diminished or stopped (or possibly reversed), and during which the pressure is permitted to decline over a time period, $t_2$, to some lesser value $P_2$. $P_2$ may lie at a portion of the difference between the high pressure value $P_1$, and the initial unpressurized value $P_0$, or may be roughly the initial unpressurized value $P_0$.

At the end of that time period, $t_2$, the gas under pressure may again be introduced (or reintroduced, as may be) in a second surge S2 at a flow rate $q_2$ over a time period $t_3$, to raise the pressure in the well bore to a high pressure $P_3$. During this surge S2 another amount of proppant $O_2$ may be added to the frac fluid to be conveyed downhole.

The surge S2 may be followed by another time period, $t_4$, of relaxation R2 in which the pressure may fall to a lower pressure $P_4$, which may be followed by another pressure rise over a time period to a high pressure, and another period of relaxation to a reduced pressure. Additional pulses may follow in a similar manner, each pulse having a rising pressure phase and a falling pressure phase. Alternately, the procedure may be stopped after surge S2 or any surge thereafter. This is indicated, generically, in the wavetrain illustration of FIG. 3.

It may be that this comparatively large pressure rise, occurring at a relatively high rate, may tend to result in brisk crack dilation, or crack propagation, notwithstanding the comparative lack of vertical restraint on the seam or stratum of interest given the comparatively low overburden pressure. It is further believed that a process of introducing a fluid under pressure to "frac" the well, i.e., to open up, or dilate, the adjacent porous structure along its fracture surfaces, may tend to occur in first a radiating manner forming main fractures 150 from the well bore, in for example, the first pressurizing step and then in later pressurizing steps, there may be the formation and/or enlargement of dendritic crack formations 152 in the adjacent geological structures. That is, the fractures in a formation may tend to first run generally in one direction through main cracks, which may tend to run in that one direction and then the fractures may branch laterally, termed dendritic cracks or fractures, tending to extend away, possibly perpendicularly away, from the main primary fractures, may tend to link parallel fractures, branch fractures and create more laterals. This fracture generation may tend to enhance the flow running through those the main fractures, and ultimately to the well bore. It may be that the rate of hydrocarbon production may improve where fractures are generated dendritically.

The natural pressure in the well bore may be generally about 100-150 psia (0.7-1.0 MPa). Using reference to FIG. 3, in one embodiment, starting from the initial well bore pressure, $P_0$, the gas may be introduced in the first surge S1 at a flow rate $q_1$, of at least 300 scm or possibly at least 1000 scm over a time period $t_1$ of 1 to 20 minutes or possibly 1 to 10 minutes, to raise the pressure in the stratum, as measured in the well bore, to an elevated level, $P_1$. Following this rise, the period of relaxation R1 may occur in which the inflow of frac gas may be greatly diminished or stopped to a rate of less than 300 scm, and during which the pressure is permitted to decline over a time period, $t_2$ of less than 24 hours or possibly less than 12 hours and in one embodiment less than one hour, to some lesser value $P_2$. An amount of proppant $O_1$ was added after break down with surge S1. Since the proppant is generally entrained with the inflow of frac gas for conveyance to the formation, the introduction of proppant O was initiated after the surge S1 is initiated and is discontinued prior to or with the discontinuance of the surge.

At the end of that time period, $t_2$, the gas under pressure may again be introduced (or reintroduced, as may be) as surge S2 at a flow rate $q_2$ of at least 300 scm or possibly at least 1000 scm over a time period $t_3$ of 1 to 20 minutes or possibly 1 to 10 minutes to raise the pressure in the well bore to a high pressure $P_3$. In the illustrated embodiment, an amount of proppant $O_2$ was added with surge S2 and the injection assembly eventually sanded off, as indicated by the sharp increase in the surface pressure to a maximum peak $P_{3a}$.

Further time periods, $t_4$, etc. may then follow or the process may be stopped.

The surface pressure $P_{1a}$ of the introduced gas during surge S1 may be greater than 2000 psi, or possibly greater than 5000 psia and in one embodiment may be about 5000-8000 psia. Expressed alternatively, the peak pressure may be more than double, and perhaps in the range of 3 to 10 times as great as the overburden pressure at the location of the stratum, or seam, to be dilated. Not only may the frac fluid be introduced at a surface pressure of greater than 2000 psi, or, indeed greater than 3000 psi, but, in addition, the frac gas may be introduced at a high rate, such that the rate of pressure rise in the surrounding stratum or seam of interest may be rapid. This rate of pressure rise may be measured in the well bore as a proxy for the rise in the surrounding formation, or fracture zone. For example, the rate of flow may be as great or greater, than required to achieve a pressure rise of 500 psi bottom hole pressure in the well bore over an elapsed time of 100 second or less, and may be such as to raise the pressure 500 psi in the range of 50 to 75 seconds.

Figure 4:
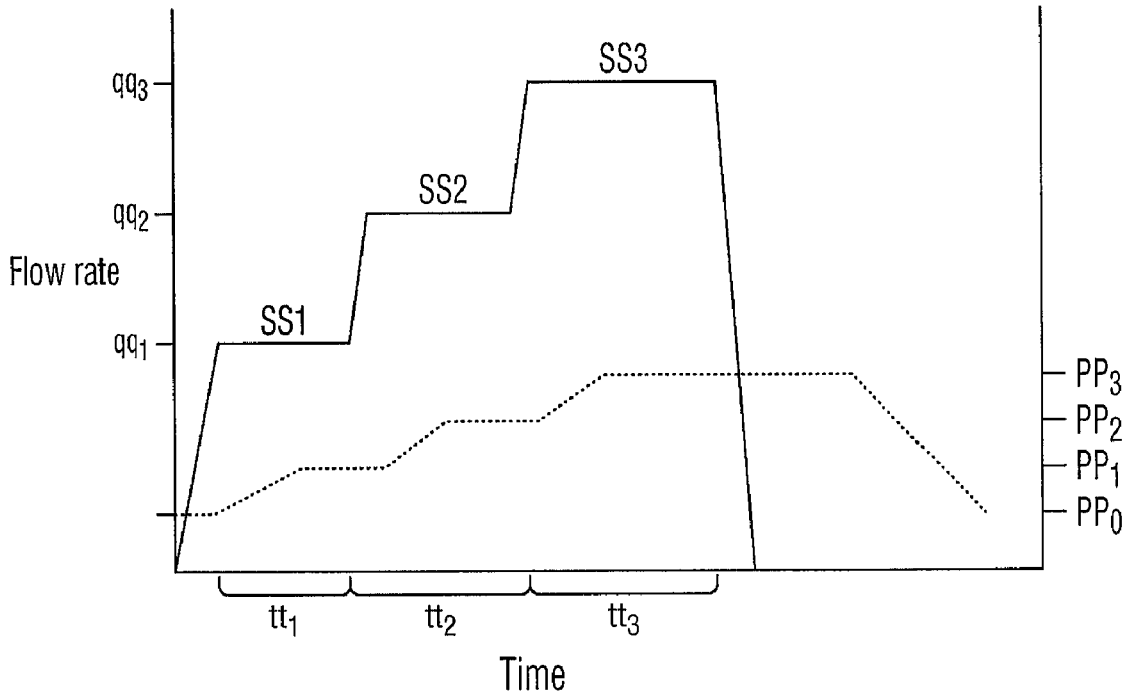
FIG. 4 shows a chart of flow rate and observed pressure against time for a process of fracture dilation.

In another embodiment, with reference to FIG. 4, the introduction of frac fluid, such as non-participating frac gas, may be a stepped process involving a number of iterations of raising pressure in the well bore, such as a first surge SS1, followed by a second surge SS2 and a third surge SS3, etc. followed by ceasing the introduction of gas or followed by a period of relaxation before another step of introducing frac fluid into the formation. An amount of proppant may be entrained with the frac gas in any or all of the surges, but in the illustrated an amount of proppant $OO_2$ was added with surge SS2.

In general, with reference to FIG. 4, a frac fluid in the form of a non-participating gas may be introduced into well bore 50 to pressurize the well bore more than one time. That is, starting from an initial well bore pressure, $P_0$, a first surge SS1 of gas may be introduced at a flow rate $qq_1$, over a time period $tt_1$ to raise the pressure in the stratum, as measured in the well bore, to an elevated level, $PP_1$. Following this rise, the flow of gas can be adjusted by increasing the flow to cause a second surge SS2 at a flow rate $qq_2$ over a time period $tt_2$, to raise the pressure in the well bore to a high pressure $PP_2$. Following this, the flow of gas can be adjusted by again increasing the flow to cause a third surge SS3 at a flow rate $qq_3$ over a time period $tt_3$, to raise the pressure in the well bore to a high pressure $PP_3$. This may be followed by further surges or the process may be ceased.

It is believed that such a process may also generate radiating and then dendritic fracturing.

In such an embodiment, starting from an initial well bore pressure, $P_0$, the gas may be introduced in the first surge SS1 at a flow rate $qq_1$ of at least 300 scm or possibly at least 1000 scm over a time period $tt_1$ of 1 to 20 minutes or possibly 1 to 10 minutes, to raise the pressure in the stratum, as measured in the well bore, to an elevated level, $PP_1$. Following this rise, the flow rate of gas under pressure may be adjusted upwardly to cause surge SS2 over a time period $tt_2$ of 1 to 20 minutes or possibly 1 to 10 minutes, to raise the pressure in the well bore to a high pressure $P_3$. Then the flow rate of gas under pressure may again be adjusted upwardly to cause surge SS3 over a time period $tt_3$ of 1 to 20 minutes or possibly 1 to 10 minutes, to raise the pressure in the well bore to a high pressure $PP_3$.

Prior to a surge, it may be desired to introduce fluid to fill a void volume in the seam or region to be treated. These periods of introduction to fill the volume of the seam may take longer time periods and be completed at lower flow rates than those disclosed above with respect to the surges of interest. When the wellbore/formation void becomes filled, fracture initiation can commence, which is often termed "break down".

In one embodiment, the entire process of surges and relaxation periods may be completed in a period of less than 24 hours and possibly less than one hour.

The proppant may be added at any stage where gas is introduced to the formation. Generally, proppant injection begins either shortly before, at or at any time after fracture initiation. In one embodiment, proppant introduction is initiated no earlier than break down. The addition of proppant may depend on the state of the formation. For example, by observation of surface pressure, formation pressure and/or flow capabilities, it can be observed whether or not fractures are being formed. Proppant may only be introducible if the fracturing fluid flow is significant enough to permit entrainment of the proppant and the formation is capable of receiving it. For example, if the formation and/or surface pressure is very high, this may indicate that the formation is very tight and won't reasonably accept the proppant.

In some instances, when a stratum of interest is to receive a frac treatment as described above, some pretreatments may be required or desired, as will be appreciated.

The following example is provided only for illustrative purposes and to facilitate understanding. The following example, is not intended to limit the invention, but rather to facilitate understanding thereof.

EXAMPLE

Figure 5A:
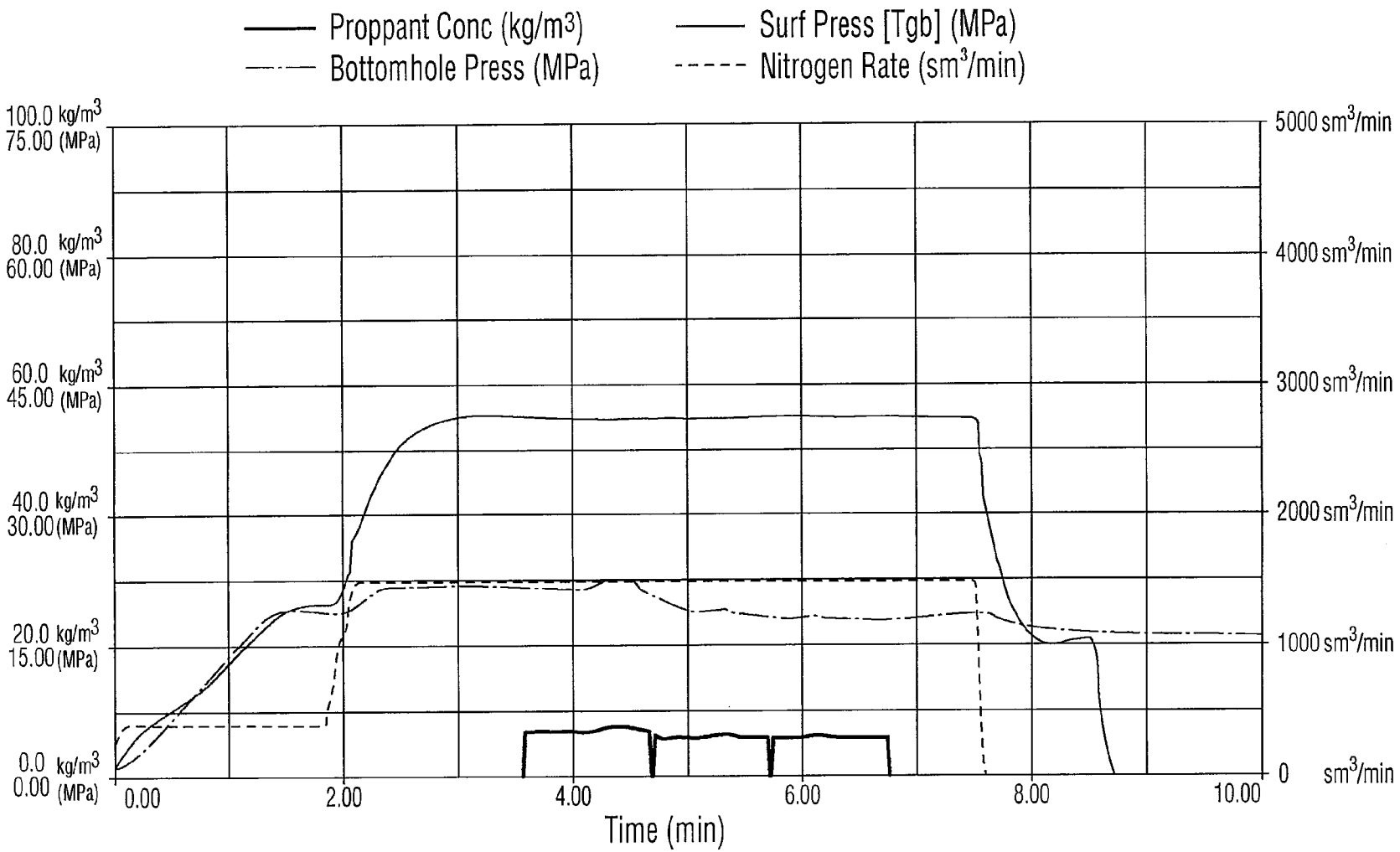
FIGS. 5*a* and 5*b* are graphs showing the treatment regime and resultant pressure for one example well bore treatment.
Figure 5B:
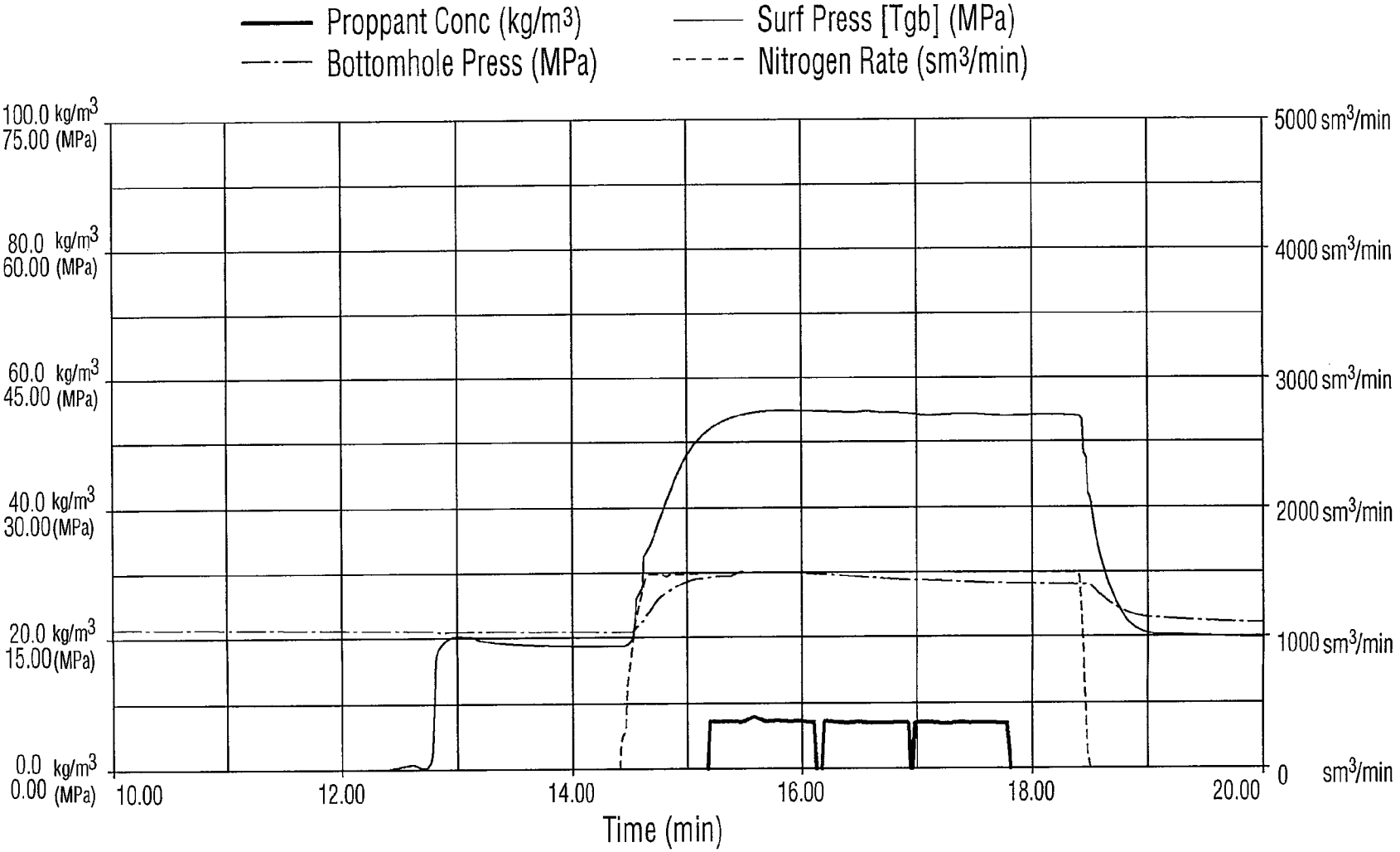

In a treatment of a Edmonton-type coal seam in an Edmonton-type sand formation, a coiled tubing with fracturing straddle packer was run into a well lined with a perforated pipe. The fracturing straddle packer was positioned about a set of perforations providing access to a pair of coal intervals of the formation through which the well was formed. Once positioned, with reference to FIGS. 5*a* and 5*b*, nitrogen was injected down the coil at a selected pumping rate to achieve breakdown. Then an amount of a proppant known as SanSpal™, Sanjel Corporation, was introduced to the nitrogen stream and displaced into the interval with the nitrogen. Thereafter, nitrogen injection and proppant introduction was stopped. After a period of time a second treatment cycle was initiated wherein nitrogen injection was started again and a second amount of proppant was introduced with the injected nitrogen. Thereafter, the nitrogen injection was ceased. The straddle packer was moved to treat further intervals of the well and the straddle packer was removed from the well.

In the well bore treatment of the present example, the amount of proppant during each cycle was introduced from three separate pots, as shown by the graphical representation of the treatment.

In the treatment of further well bore intervals treatment parameters were varied including: nitrogen injection cycle frequency, rates and volumes and injected proppant volumes and concentrations. The initial and resultant surface and bottomhole pressures varied as well.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A process for fracturing a selected region of a formation comprising: (a) introducing a supply of fracturing fluid to the region of the formation until a first threshold is reached, (b) relaxing the flow of the fracturing fluid to the region of the formation to reach a second threshold, (c) after step (b), either (i) further relaxing the flow or (ii) increasing the flow, of the fracturing fluid to the region of the formation to reach a third threshold and (d) ceasing flow of the fracturing fluid to region of the formation, the fracturing fluid being a non-participating gas and including a proppant in at least one of the stages of flow of the fracturing fluid.

2. The process of claim 1 wherein after reaching the third threshold and prior to ceasing flow, further thresholds are reached by adjustment of fracturing fluid flow to the region before ceasing the process.

3. The process of claim 1 wherein the region of the formation includes at least one coal seam.

4. The process of claim 1 wherein the non-participating gas is substantially free of water.

5. The process of claim 1 wherein the non-participating gas includes nitrogen.

6. The process of claim 1 wherein the non-participating gas is substantially inert in terms of its chemical interaction with at least the material of the region.

7. The process of claim 1 wherein the proppant includes a material introduced for any of propping, spalling, etching and/or pillaring in the formation.

8. The process of claim 1 wherein the proppant is capable of being carried by the nonparticipating gas to the seam.

9. The process of claim 1 wherein the proppant has a specific gravity of less than 4.

10. The process of claim 1 wherein the proppant includes at least one of plastic, resin, composite, ceramic, metal, sand, natural treated granular materials, natural untreated granular materials, wood/bark, shells and nut shells.

11. The process of claim 1 wherein relaxing the flow includes at least one of: extracting a portion of the fracturing fluid from the well bore, slowing fluid flow into the wellbore, stopping flow of fracturing fluid into the well bore and permitting the fracturing fluid to propagate into a fracture region in the seam adjacent to the well bore.

12. The process of claim 1 wherein increasing the flow includes at least one of: resuming fluid flow and/or increasing fluid flow over an existing and previous flow.

13. The process of claim 1 wherein the process is cyclic and step (c) includes increasing fluid flow to the region of the wellbore.

14. The process of claim 1 wherein the introduction of fracturing fluid may include introducing a volume to substantially fill the void space in the formation prior to introducing fluid to reach the first threshold.

15. The process of claim 1 wherein the first, the second and the third thresholds are reached within a twenty-four hour period.

16. The process of claim 1 wherein the non-participating gas is introduced to the formation at a rate of at least 300 standard cubic meters/minute (scm).

17. The process of claim 1 wherein the first, second and third thresholds are defined by at least one criterion selected from a set of criteria consisting of: (a) a time period threshold; (b) a non-participating gas flow rate threshold; (c) a well bore surface or bottom hole pressure threshold; (d) a well bore surface or bottom hole rate of pressure change threshold; (e) a gas quantity threshold and (f) a formation condition threshold.

18. The process of claim 1 wherein the first threshold is selected from the group consisting of (a) a time period in the range of 30 seconds to 20 minutes, (b) a flow rate of fluid of at least 300 scm, and (c) a combination of a time period in the range of 30 seconds to 20 minutes and a flow rate of dilation fluid of at least 300 scm.

19. The process of claim 1 wherein the first threshold is defined as an introduction of fluid for a time period in the range of 1 to 10 minutes and a flow rate of dilation fluid of at least 1000 scm.

20. The process of claim 1 wherein the first threshold is defined, at least in part, by an introduction of dilation fluid for a period of 30 seconds to 20 minutes at a flow rate of at least 300 scm, the second threshold is defined as a time period of more than 1 minute and less than 24 hours of a flow rate of dilation fluid of less than 300 scm and the third threshold is defined as an introduction of dilation fluid for a period of 30 seconds to 20 minutes at a flow rate of at least 300 scm.

21. The process of claim 1 wherein at least one of the first, the second or the third threshold is considered to have been reached after a selected pressure is maintained for a selected time.

22. The process of claim 1 wherein at least one of the first, the second or the third threshold is considered to have been reached when the pressure change per unit time is reduced below a selected level.

23. The process of claim 1 wherein the first threshold is selected from the group consisting of: (a) a peak surface pressure of at least 2000 p.s.i.; (b) a peak bottom hole pressure, measured in the well bore, of at least 500 p.s.i.; and (c) a combination of a time period in the range of 30 seconds to 20 minutes and a peak pressure as in (a) or (b).

24. The process of claim 1 wherein the first threshold is selected from the group consisting of: (a) a peak surface pressure of at least 4500 p.s.i.; (b) a peak bottom hole pressure, measured in the well bore of at least 1000 p.s.i; and (c) a combination of a time period in the range of 1 to 10 minutes and a peak pressure as in (a) or (b).

25. The process of claim 1 wherein the first threshold is defined, at least in part, by a peak pressure, and the second threshold is defined, at least in part, as a proportion of that peak pressure.

26. The process of claim 1 wherein at least one of the first, the second and the third thresholds includes a formation condition threshold including lateral fracture generation.

27. The process of claim 1 wherein at least one of the first, the second and the third thresholds includes a formation condition threshold including dendritic fracture generation.

28. A process of dilating fractures in a first coal seam adjacent to a well bore, the process comprising the steps of: pressurizing and permitting pressure relaxation of the first coal seam a plurality of times in less than a twenty-four hour period, wherein at least one of the steps of pressurizing includes urging a fracture dilation fluid with a proppant into the first coal seam, the fracture dilation fluid being substantially entirely a non-participating gas.

29. The process of claim 28 wherein the proppant includes a material introduced for any of propping, spalling, etching and/or pillaring in the formation.

30. The process of claim 28 wherein the proppant is capable of being carried by the dilation fluid to the seam.

31. The process of claim 28 wherein the proppant has a specific gravity of less than 4.

32. The process of claim 28 wherein the proppant includes at least one of plastic, resin, composite, ceramic, metal, sand, natural treated granular materials, natural untreated granular materials, wood/bark, shells and nut shells.

33. The process of claim 28 wherein the process further comprises moving to a second coal seam in the well bore and conducting a process including the step of pressurizing with a fracture dilation fluid and permitting pressure relaxation of the second coal seam in less than a twenty-four hour period, wherein the fracture dilation fluid is substantially entirely a non-participating gas.

34. The process of claim 33 wherein the process further comprises introducing a proppant with the fracture dilation fluid into the second seam.

35. The process of claim 33 wherein the process further comprises further steps of pressurizing with a fracture dilation fluid and permitting pressure relaxation of the second coal seam in less than a twenty-four hour period.

36. A process of dilating fractures in a coal seam adjacent to a well bore, that process comprising the steps of: pressurizing and permitting pressure relaxation of the coal seam a plurality of times, wherein at least one of the steps of pressurizing includes introducing a fracture dilation fluid with a proppant into the coal seam, the fracture dilation fluid including a non-participating gas, and at least one of the steps of pressurizing including the step of introducing the fracture dilation fluid at a rate of greater than 300 scm.

37. The process of claim 36 wherein the process includes a first pressurizing step wherein dilation fluid is introduced at a rate of greater than 1000 scm, a pressure relaxation step thereafter and a second pressurization step wherein dilation fluid is introduced at a rate of greater than 1000 scm, wherein the first and the second pressurizing steps are completed in a time period of less than 24 hours.

38. The process of claim 36 wherein the proppant is introduced in the first pressurizing step.

39. The process of claim 36 wherein the proppant is introduced in the second pressurization step.

40. The process of claim 36 wherein the proppant is capable of being carried by the dilation fluid to the seam.

41. The process of claim 36 wherein the proppant has a specific gravity of less than 4.

42. The process of claim 36 wherein the proppant includes a material introduced for any of propping, spalling, etching and/or pillaring in the formation.

43. The process of claim 36 wherein the proppant includes at least one of plastic, resin, composite, ceramic, metal, sand, natural treated granular materials, natural untreated granular materials, wood/bark, shells and nut shells.

44. A process of dilating fractures in a seam of a formation adjacent to a well bore, that process comprising: pressurizing the seam of the formation and thereafter permitting pressure relaxation of the seam, the pressurizing and the pressure relaxation each being repeated in sequence a plurality of times, wherein at least once pressurizing includes introducing a fracture dilation fluid with a proppant into the seam, the fracture dilation fluid being substantially entirely non-participating gas and wherein at least once pressurizing includes a step of imposing a peak pressure in the wellbore adjacent the seam, the peak pressure being capable of fracture dilation, and wherein the proppant includes a material introduced for any of propping, spalling, etching and/or pillaring in the formation.

45. A process of dilating fractures in a seam of a formation adjacent to a well bore, that process comprising: pressurizing the seam of the formation and thereafter permitting pressure relaxation of the seam, the pressurizing and the pressure relaxation each being repeated in sequence a plurality of times, wherein at least once pressurizing includes introducing a fracture dilation fluid with a proppant into the seam, the fracture dilation fluid being substantially entirely non-participating gas and wherein at least once pressurizing includes a step of imposing a peak pressure in the wellbore adjacent the seam, the peak pressure being capable of fracture dilation, and wherein the proppant is capable of being carried by the dilation fluid to the seam.

46. A process of dilating fractures in a seam of a formation adjacent to a well bore, that process comprising: pressurizing the seam of the formation and thereafter permitting pressure relaxation of the seam, the pressurizing and the pressure relaxation each being repeated in sequence a plurality of times, wherein at least once pressurizing includes introducing a fracture dilation fluid with a proppant into the seam, the fracture dilation fluid being substantially entirely non-participating gas and wherein at least once pressurizing includes a step of imposing a peak pressure in the wellbore adjacent the seam, the peak pressure being capable of fracture dilation, and wherein the proppant has a specific gravity of less than 4.

47. A process of dilating fractures in a seam of a formation adjacent to a well bore, that process comprising: pressurizing the seam of the formation and thereafter permitting pressure relaxation of the seam, the pressurizing and the pressure relaxation each being repeated in sequence a plurality of times, wherein at least once pressurizing includes introducing a fracture dilation fluid with a proppant into the seam, the fracture dilation fluid being substantially entirely non-participating gas and wherein at least once pressurizing includes a step of imposing a peak pressure in the wellbore adjacent the seam, the peak pressure being capable of fracture dilation, and wherein the proppant includes at least one of plastic, resin, composite, ceramic, metal, sand, natural treated granular materials, natural untreated granular materials, wood/bark, shells and nut shells.

48. A process of dilating fractures in a coal seam adjacent to a well bore, that process comprising the steps of: pressurizing and permitting pressure relaxation of the coal seam a plurality of times, wherein at least once pressurizing includes introducing a fracture dilation fluid with a proppant into the coal seam, the fracture dilation fluid including a non-participating gas and the proppant having a specific gravity of less than 4 being entrained in the fracture dilation fluid by use of a fracture dilation flow rate of greater than 300 scm.

49. The process of claim 48 wherein the proppant is entrained with the flow of the fracture dilation fluid by employing a rate of at least 1000 scm.

50. The process of claim 48 wherein the proppant has a specific gravity of between about 0.5 and 3.

51. A process of dilating fractures in a coal seam adjacent to a well bore, that process comprising the steps of: pressurizing and permitting pressure relaxation of the coal seam a plurality of times, wherein at least once pressurizing includes introducing a fracture dilation fluid with a proppant into the coal seam, the proppant being entrained with the flow of fracture dilation fluid at least two times during the process wherein the proppant is entrained with the flow of fracture dilation fluid by employing a rate of at least 300 standard cubic meters/minute.

52. The process of claim 51 wherein the at least two times of proppant entrainment occur during one of the times of pressurizing.

53. The process of claim 51 wherein the at least two times of proppant entrainment include amounts of proppant during two separate times of pressurizing.

54. The process of claim 51 wherein the proppant is entrained with the flow of fracture dilation fluid by employing a rate of at least 1000 standard cubic meters/minute.

55. A process of dilating fractures in a coal seam adjacent to a well bore, that process comprising the steps of: pressurizing and permitting pressure relaxation of the coal seam a plurality of times, wherein at least once pressurizing includes introducing a fracture dilation fluid with a proppant into the coal seam, the proppant being entrained with the flow of fracture dilation fluid at least two times during the process wherein the proppant has a specific gravity of less than 4.

56. The process of claim 55 wherein the proppant has a specific gravity of between about 0.5 and 3.

57. A process for fracturing a selected region of a formation comprising: (a) introducing a supply of fracturing fluid to the region of the formation until a first threshold is reached, (b) increasing the flow of the fracturing fluid to the region of the formation to reach a second threshold, (c) after step (b), either (i) relaxing the flow or (ii) further increasing the flow, of the fracturing fluid to the region of the formation to reach a third threshold and (d) ceasing flow of the fracturing fluid to region of the formation, the fracturing fluid being a non-participating gas and including a proppant in at least one of the stages of flow of the fracturing fluid.

58. The process of claim 57 wherein after reaching the third threshold and prior to ceasing flow, further thresholds are reached by adjustment of fracturing fluid flow to the region before ceasing the process.

59. The process of claim 57 wherein the region of the formation includes at least one coal seam.

60. The process of claim 57 wherein the non-participating gas is substantially free of water.

61. The process of claim 57 wherein the non-participating gas includes nitrogen.

62. The process of claim 57 wherein the non-participating gas is substantially inert in terms of its chemical interaction with at least the material of the region.

63. The process of claim 57 wherein the proppant includes a material introduced for any of propping, spalling, etching and/or pillaring in the formation.

64. The process of claim 57 wherein the proppant is capable of being carried by the nonparticipating gas to the seam.

65. The process of claim 57 wherein the proppant has a specific gravity of less than 4.

66. The process of claim 57 wherein the proppant includes at least one of plastic, resin, composite, ceramic, metal, sand, natural treated granular materials, natural untreated granular materials, wood/bark, shells and nut shells.

67. The process of claim 57 wherein relaxing the flow includes at least one of: extracting a portion of the fracturing fluid from the well bore, slowing fluid flow into the wellbore, stopping flow of fracturing fluid into the well bore and permitting the fracturing fluid to propagate into a fracture region in the seam adjacent to the well bore.

68. The process of claim 57 wherein increasing the flow includes at least one of: resuming fluid flow and/or increasing fluid flow over an existing and previous flow.

69. The process of claim 57 wherein the process includes a stepped flow rate regime and step (c) includes either increasing or relaxing fluid flow to the region of the wellbore.

70. The process of claim 57 wherein the introduction of fracturing fluid may include introducing a volume to substantially fill the void space in the formation prior to introducing fluid to reach the first threshold.

71. The process of claim 57 wherein the first, the second and the third thresholds are reached within a twenty-four hour period.

72. The process of claim 57 wherein the non-participating gas is introduced to the formation at a rate of at least 300 standard cubic meters/minute (scm).

73. The process of claim 57 wherein the first, second and third thresholds are defined by at least one criterion selected from a set of criteria consisting of: (a) a time period threshold; (b) a non-participating gas flow rate threshold; (c) a well bore surface or bottom hole pressure threshold; (d) a well bore surface or bottom hole rate of pressure change threshold; (e) a gas quantity threshold and (f) a formation condition threshold.

74. The process of claim 57 wherein the first threshold is selected from the group consisting of (a) a time period in the range of 30 seconds to 20 minutes, (b) a flow rate of fluid of at least 300 scm, and (c) a combination of a time period in the range of 30 seconds to 20 minutes and a flow rate of dilation fluid of at least 300 scm.

75. The process of claim 57 wherein the first threshold is defined as an introduction of fluid for a time period in the range of 1 to 10 minutes and a flow rate of dilation fluid of at least 1000 scm.

76. The process of claim 57 wherein at least one of the first, the second or the third threshold is considered to have been reached after a selected pressure is maintained for a selected time.

77. The process of claim 57 wherein at least one of the first, the second or the third threshold is considered to have been reached when the pressure change per unit time is reduced below a selected level.

78. The process of claim 57 wherein the first threshold is selected from the group consisting of: (a) a peak surface pressure of at least 2000 p.s.i.; (b) a peak bottom hole pressure, measured in the well bore, of at least 500 p.s.i.; and (c) a combination of a time period in the range of 30 seconds to 20 minutes and a peak pressure as in (a) or (b).

79. The process of claim 57 wherein the first threshold is selected from the group consisting of: (a) a peak surface pressure of at least 4500 p.s.i.; (b) a peak bottom hole pressure, measured in the well bore of at least 1000 p.s.i.; and (c) a combination of a time period in the range of 1 to 10 minutes and a peak pressure as in (a) or (b).

80. The process of claim 57 wherein the first threshold is defined, at least in part, by a peak pressure, and the second threshold is defined, at least in part, as a proportion of that peak pressure.

81. The process of claim 57 wherein at least one of the first, the second and the third thresholds includes a formation condition threshold including lateral fracture generation.

82. The process of claim 57 wherein at least one of the first, the second and the third thresholds includes a formation condition threshold including dendritic fracture generation.

* * * * *